United States Patent [19]

Blatt

[11] 4,151,914

[45] May 1, 1979

[54] SHIPPING AND STORAGE CONTAINER FOR ROLLS

[75] Inventor: David H. Blatt, Elkins Park, Pa.

[73] Assignee: Franklin Container Corporation, Philadelphia, Pa.

[21] Appl. No.: 927,471

[22] Filed: Jul. 24, 1978

[51] Int. Cl.[2] ..... B65D 85/66

[52] U.S. Cl. ..... 206/386; 206/395; 206/408

[58] Field of Search ..... 206/308, 386, 389, 395, 206/396, 408, 446, 595, 596, 598, 599

[56] References Cited

U.S. PATENT DOCUMENTS

| | | | |
|---|---|---|---|
| 3,332,546 | 7/1967 | De George | 206/395 |
| 4,027,794 | 6/1977 | Olson | 206/395 |

*Primary Examiner*—Donald F. Norton
*Attorney, Agent, or Firm*—Edelson and Udell

[57] ABSTRACT

A combination shipping and storage container for hollow rolls of sheet material having an open-topped box structure and a top closure therefor, both said box structure and said top closure being each formed of two open-ended sections which are telescopically interfitted to provide the same with a capability of being lengthwise adjusted in correspondence with the length of the roll stored in the container and wherein the box structure sections are each provided in the closed end thereof with means affording access for insertion of a lifting bar axially through the hollow interior of the roll supported in the box for transferring roll into and out of its container.

8 Claims, 9 Drawing Figures

FIG. 3
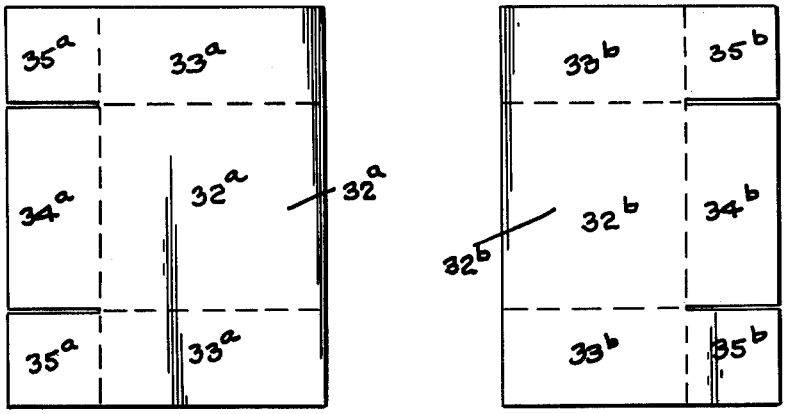
FIG. 4
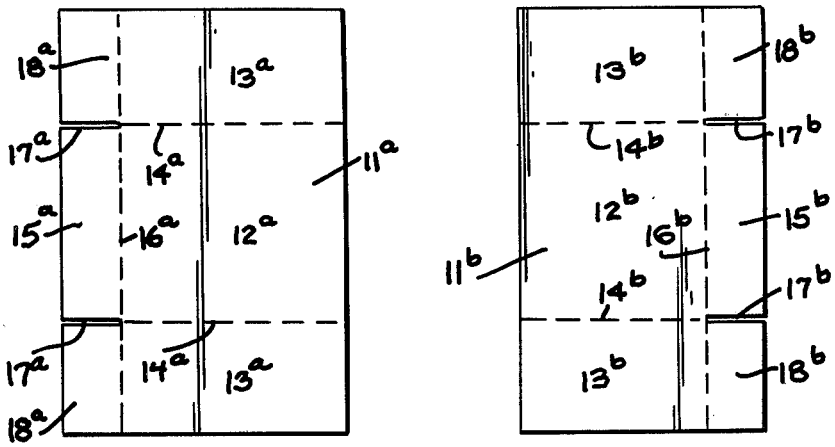
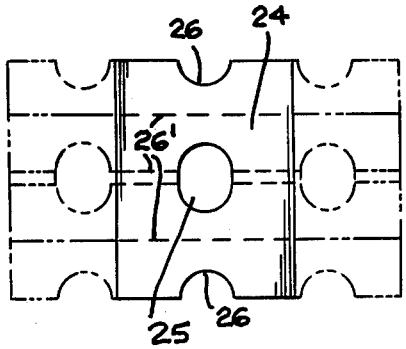
FIG. 5

FIG. 6
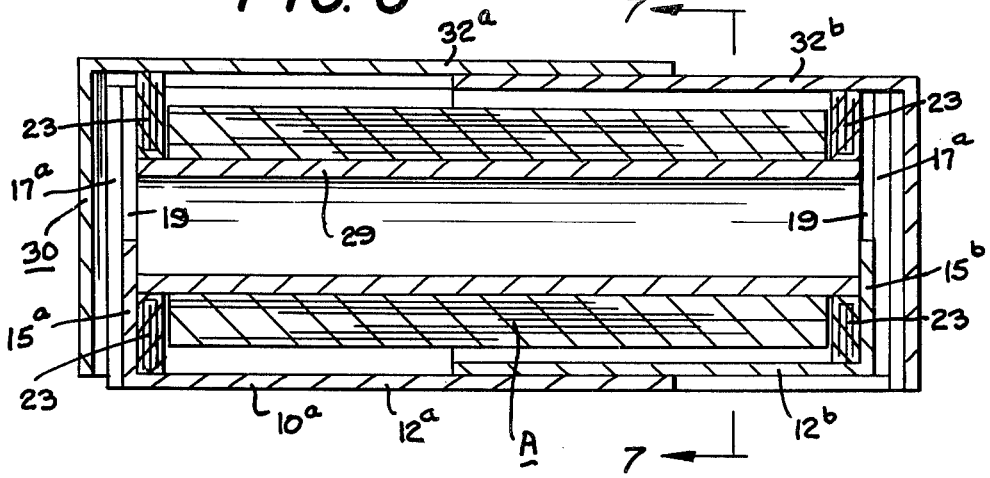
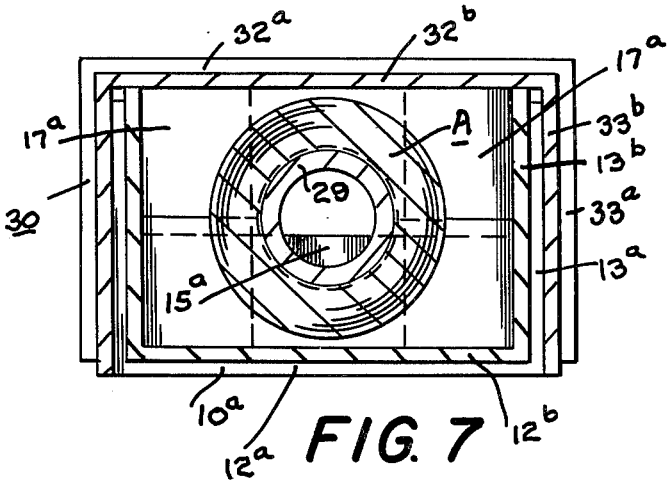
FIG. 7

FIG. 8
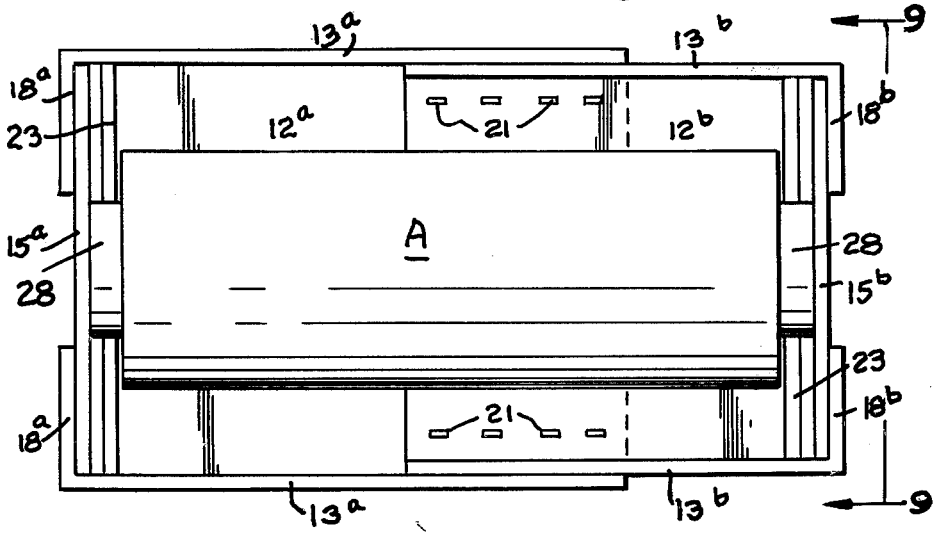
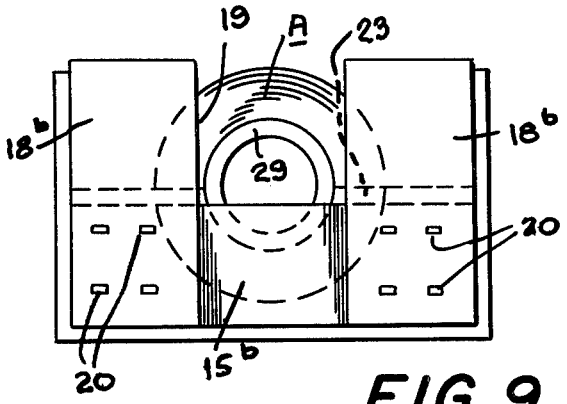
FIG. 9

SHIPPING AND STORAGE CONTAINER FOR ROLLS

This invention relates generally to shipping and storage containers and more particularly to an improved construction of shipping container designed for the reception and storage of rolls of sheet material such as plastic film, paper, cloth and the like.

While the shipping and storage container of the present invention has the same general use objectives as are set forth in the prior U.S. Pat. No. 3,332,546, granted July 25, 1967 to the assignee of this application, the principal objectives of this invention is to provide an improved construction of such type of container for increasing its versatility and for reducing the necessity and expense of maintaining on hand a costly inventory of different sizes of containers required for accomodating therein rolls of different lengths.

It will be noted that the containers of the construction shown and described in said prior patent are of a fixed lengthwise dimension to accomodate therein rolls of a prescribed length. Thus, whenever there is a change in the length of the rolls, the prior patented container had to be changed in its lengthwise dimension for each different length of roll to be stored therein, thereby requiring the user of such containers to maintain in stock a supply of containers separately sized to accomodate therein various lengths of rolls of the sheet material. Also, it was found to be frequently the case that when the manufacturer or supplier of the rolls desired to ship the same in containers, it did not have on hand any containers for a given length of roll, the latter being either too long or too short to be adequately and safely stored and shipped in whatever existing container was immediately available.

Having all of the foregoing in mind, it is an object of the present therefor to provide a sectionalized container for the rolls wherein both the roll-containing bottom box part and the top closure therefore are each formed of a pair of sections which are adapted to be telescopically assembled to an adjusted overall lengthwise dimension of the container consistent with the length of the roll or rolls of material stored therein.

A further object of the invention is to provide a sectionalized container having openings or slots in the opposite end walls of its roll-containing box assembly which are normally covered by the box top and afford access to the hollow core of the roll for insertion therethrough of means for lifting the roll out of said box assembly when the top assembly is removed.

Still another and important structural advantage of the present invention is that by virtue of the overlapping side and bottom walls of the telescopically interfitted box sections and by providing the opposite end walls thereof with overlying corner flaps which define therebetween the marginal sides of the end wall slots in registry with the hollow interiors of the contained rolls, the roll-containing box part of the container is substantially reinforced and strengthened to protect the roll contained therein.

other objects and advantages of the present invention will appear more fully hereinafter, it being understood that the invention consists substantially in the combination, construction, location and relative arrangement of parts, all as described in detail in the following specification, as shown in the accompanying drawings and as finally pointed out in the appended claims.

In the accompanying drawings:

FIG. 3 is a plan view of the slit and scored blanks which conjointly form the assembled top closure of the container;

FIG. 4 is a plan view of the slit and scored blanks which conjointly for the assembled body of the container in which the roll of stock material is received;

FIG. 5 is a plan view of one of the four identical blanks from which the end support is formed;

FIG. 6 is a horizontal cross-sectional view of the completely assembled container as taken along the line 6—6 of FIG. 1;

FIG. 7 is a transversely extending vertical crosssectional view of the container as taken along the line 7—7 of FIG. 6;

FIG. 8 is a top plan view of the roll-loaded container as it appears with the top closure removed; and FIG. 9 is an end elevational view of the structure shown in FIG. 8 as viewed from the line 9—9 thereof.

Figure 1:
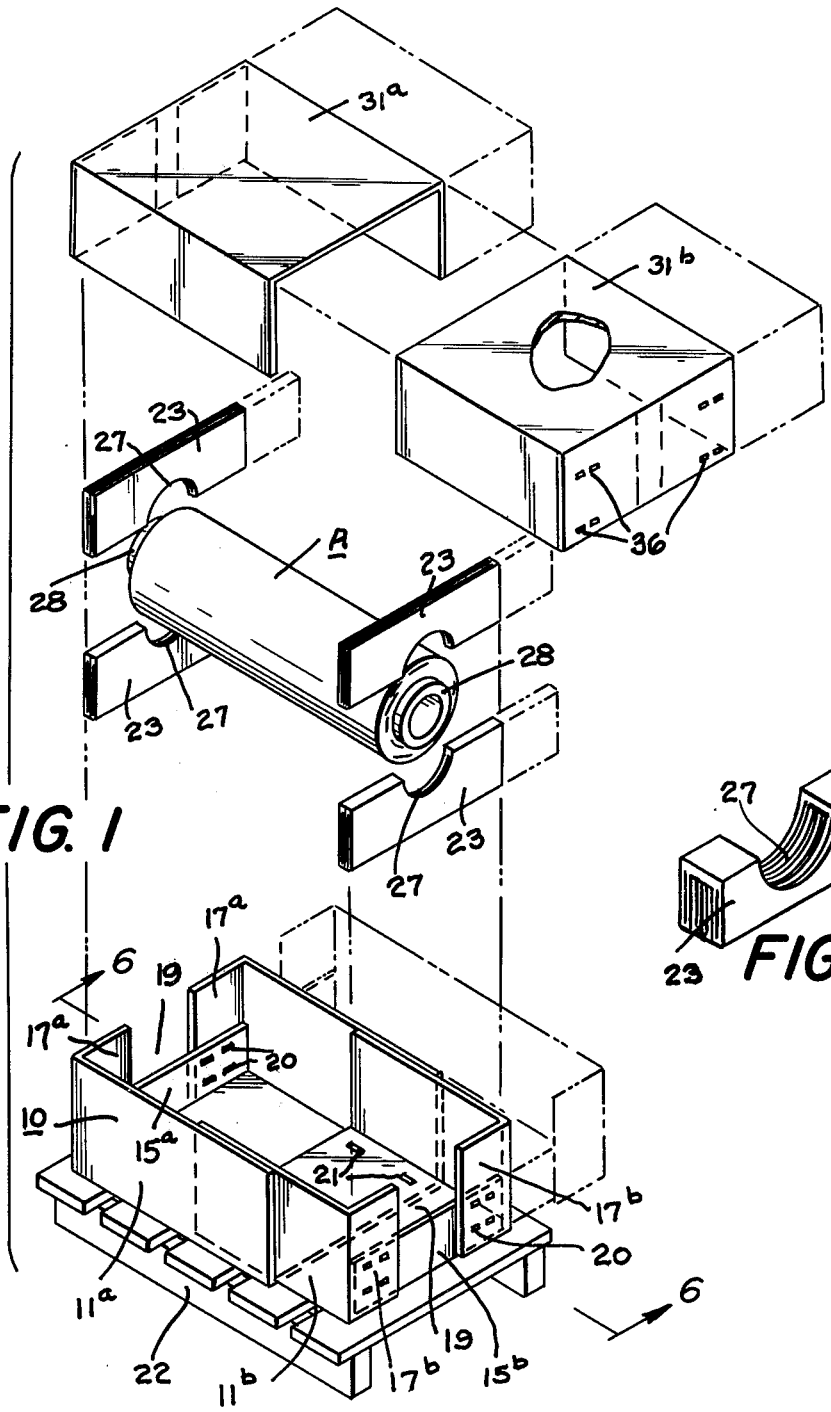
FIG. 1 is an exploded view showing in perspective the several component parts of the container constructed in accordance with and embodying the principles of the present invention, this figure showing also in perspective a roll of the stock material which the container is designed to receive.

Referring now more particularly to the drawings, it will be observed that in the container or carton constructed in accord with the present invention, both the roll-containing bottom part of the container and the top closure part thereof are each formed of a pair of sections which are adapted to be telescopically assembled to provide a complete container assembly which is variable in size to accomodate therein one or more rolls of sheet material. In the container illustrated only one such roll is shown, but it will be understood that in accord with this invention the carton may be expanded or contracted lengthwise to accomodate rolls of different length than that shown, and also be formed of different widths and depths to accomodate therein a plurality of such rolls disposed in one or more tiers thereof.

Thus, the shipping and storage container of the present invention essentially consists of an open-topped box-like unit 10 formed of a pair of similar portions respectively formed of the blanks $\mathbf{11}^a$ and $\mathbf{11}^b$, as see FIG. 4, suitably cut, slitted and scored of double-faced corrugated board which as conventionally fabricated consists of a corrugated core of paper sandwiched between a pair of outer liners of paper.

These blanks $\mathbf{11}^a$ and $\mathbf{11}^b$ are respectively provided with central or main panels $\mathbf{12}^a$ and $\mathbf{12}^b$ forming central or main bottom wall sections respectively marginally bounded by a pair of side-wall forming panels $\mathbf{13}^a$—$\mathbf{13}^a$ and $\mathbf{13}^b$—$\mathbf{13}^b$ bendable along score lines $\mathbf{14}^a$—$\mathbf{14}^a$ and $\mathbf{14}^b$—$\mathbf{14}^b$ and at one end thereof by end-wall forming panels $\mathbf{15}^a$ and $\mathbf{15}^b$ also bendable about score lines $\mathbf{16}^a$ and $\mathbf{16}^b$. These end-wall panels are respectively correspondingly slitted as at $\mathbf{17}^a$ in the case of the section $\mathbf{11}^a$ to provide a pair of corner flaps $\mathbf{18}^a$—$\mathbf{18}^a$, and at $\mathbf{17}^b$ in the case of the section $\mathbf{11}^b$ to provide a corresponding pair of corner flaps $\mathbf{18}^b$—$\mathbf{18}^b$, so that when the side and end walls of the panels $\mathbf{12}^a$ and $\mathbf{12}^b$ are upwardly bent as shown in FIG. 1, they conjointly form with the bottom wall sections to which they are joined a three-walled box unit having an open top and one open end.

As will be noted, each box unit thus formed is provided at the closed end thereof with an upstanding end-wall panel of a limited depth less than the depth of the side walls and the corner flaps and that the latter are folded against said end panel, preferably against the outside surface thereof, to provide an open-topped slot or opening 19 in said end wall. The corner flaps 17$^a$—17$^a$ and 17$^b$—17$^b$ of the box section 11$^a$ and 11$^b$ are respectively secured to the end wall panels 15$^a$ and 15$^b$ in any manner and by any suitable means, as, for example, by staples 20.

The tolerances inherent in the construction of these box-like units enables them to be readily telescoped one into the other to provide the box with a capacity for lengthwise or contraction or expansion, the extent of which may be adjusted within the limits of their slidably associated side walls. When so adjusted to lengthwise size, the bottom walls of said sections 11$^a$ and 11$^b$ may be secured together, as by staples 21 or otherwise, or if desired, the assembled sections 11$^a$ and 11$^b$ may be commonly secured to an underlying pallet 22 for ready handling and transfer of the loaded container.

The transverse overall width of the dual-section box portion of the container may vary as may be desired, as shown by the dotted line representation shown in FIG. 1, thereby increasing the width of the end slots or openings 19 thereof for accomodation in side by side relation of two or more rolls A of the sheet material stored in the container. And likewise, if desired the depth of the container may be varied as desired to accomodate two or more tiers of the rolls A.

Figure 2:
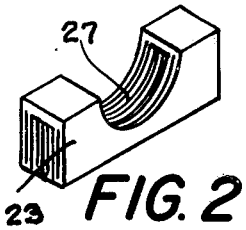
FIG. 2 is a perspective view of one of the end supports for the roll stored in the container.

The roll A of sheet material is firmly and positively supported in the assembled box structure by cradle-like supports 23 substantially similar to those shown in the aforesaid prior U.s. Pat. No. 3,332,546, each being formed of a blank 24 of corrugated paper stock, shown in full line in FIG. 5, having a central aperture 25 and semi-circular notches 26 along each of its opposite edges respectively adapted for registry with the semi-circular edges of the aperture 25 when the blank 24 is folded upon itself along the longitudinally extending parallel fold lines 26'. When so folded upon itself the apertured and notched blank 24 provides a rigid cradle-like unit 23 as shown in FIG. 2 having a semi-circular seat 27 of a size and shape adapted to snugly accomodate the normally outwardly projecting end 28 of the cylindrical hollow core 29 of the roll of sheet material contained in the box.

It will be noted that the cradle-like supports 23 are disposed in paired relation within the box at each of its opposite ends with the correspondingly notched seats 27 thereof presenting toward one another so that they conjointly form substantially circular seats which completely embrace the projecting ends of the roll cores to hold the same firmly in position within the box. Also, it should be noted that the bottom-most one of each paired set of the cradle members 23 supports the full weight of the roll in the bottom and that the circular sets of said paired cradle members respectively extend sufficiently above the top edges of the box end-wall panels 15$^a$ and 15$^b$ and in registry with the end wall slots 19—19 to permit the free projection through the hollow core of the roll of a lifting bar or the like (not shown) for placement of the rolls into or removal thereof from the box.

Where the box is designed to receive a single tier of several rolls, as shown for example in the aforesaid prior U.S. Pat. No. 3,332,546, the cradle members 23 are extended widthwise to provide the same with as many roll-accomodating seats as may be necessary, as see FIG. 5 which shows in broken line the cradle blank extended to provide seats for three laterally spaced rolls. And where the box is designed to receive two or more rolls in vertically stacked relation each end of the box is interiorly fitted with a corresponding number of paired cradle members disposed in vertically stacked relation. In either event, the construction of the box provides at each end thereof a single opening or slot similar to the slot 19 as shown in the drawings which is of a width and depth sufficient to afford insertion of a lifting bar through the hollow core of the roll to be placed in or lifted from the box.

The two-part box 10 constructed as hereinbefore described is adpated to be fitted with and enclosed by a box top 30, as see FIGS. 6 and 7, also formed of two sections 31$^a$ and 31$^b$ from the suitably cut, scored and folded panels 32$^a$ and 32$^b$ shown in FIG. 3 to respectively provide the same with top wall panels 32$^a$–32$^b$, side wall panels 33$^a$–33$^b$ and end wall panels 34$^a$–34$^b$ having the overlying corner flaps 35$^a$–35$^b$ stapled as at 36 or otherwise secured to said end wall panels. As in the case of the roll-receiving box-like structure 10, each of the box top sections 31$^a$ and 31$^b$ is completely open at one end thereof to enable the same to be telescopically interfitted to provide a top assembly to closely enclose the box structure 10. Also as in the case of the latter, the box top may vary in size to adequately fit the roll-supporting box and when telescopically adjusted to size the two sections of the top may be stapled or otherwise secured together in their assembled relation. It will be noted however that the top units 31$^a$–31$^b$ differ from the box units 11$^a$–11$^b$ in that the side and end walls of the top units are all of a uniform depth to completely overlie all of the corresponding side and end walls of the assembled box unit. Thus, when the top is fitted on the roll-containing box, the end walls of the assembled top overlie and protectively cover the end wall slots 19 of the box.

it will be appreciated that by forming both the box 10 and its top 30 of two parts adapted to be telescopically assembled as described, the requisite inventory of storage containers constructed as shown and described in the aforesaid U.S. Pat. No. 3,332,546 is drastically reduced, especially since the overall length of the roll container of any particular width and height may be telescopically adjusted to accomodate rolls of different lengths. Also, it will be apparent that the two sections of a container of a predetermined width and depth need not be of the same length since the only requirement is that the assembled sections be of lengths sufficient to provide an adequate overlap of the side walls thereof. Thus, for the assembly of a given size of container to receive and store therein rolls of a given length it is only necessary to maintain in stock a sufficient supply of the top blanks 11$^a$–11$^b$ and the bottom blanks 31$^a$–31$^b$ which may be assembled as described to provide cartons with sufficient overlap of its side walls for accomodating therein the rolls of sheet material.

It will be apparent that the container of the present invention serves ideally to store therein one or more horizontally disposed rolls and that when it is desired to remove a roll from storage in the container, it is only necessary to remove the top thereof and the uppermost one of the paired cradle members which support that roll for instant projection of a lifting bar through the bore of the roll for its removal from the container.

It will be understood of course that the present invention is susceptible of various changes and modifications which may be made from time to time without departing from the general principles or real spirit of the invention, and it is intended accordingly to claim the same broadly as well as specifically, as indicated in the accompanying claims.

What is claimed as new and useful is:

1. In a combination shipping and storage container for rolls of sheet material each having a central tubular supporting core with freely projecting end portions, an open-topped box structure formed of a pair of separate sections each having a bottom and oppositely disposed vertically extending side walls and a single upstanding end wall extending transversely between corresponding ends of said side walls, said sections being telescopically interfitted with their corresponding bottom and side walls disposed in overlapping relation whereby to provide said structure with a pair of opposite end walls which are spacially adjustable to accomodate therebetween a roll of given length, roll cradling means disposed interiorly of the box structure adjacent each of said opposite end walls thereof for supporting each roll with its axis extending lengthwise between said end walls, and means in said end walls affording access therethrough for insertion of a lifting device across said cradling means and axially through the roll supported thereby.

2. A shipping and storage container for rolls of sheet material as defined in claim 1 wherein said cradling means consists of a pair of spacer members disposed respectively flatwise against the inner surfaces of said and end walls of the box structure to constitute rests for the oppositely projecting ends of the roll supporting core and wherein said end walls are respectively provided with upstanding open-topped slots having horizontally extending bottom edges extending chordally across said ends of said roll supporting core at elevations which expose the interior of the core for projection therethrough of said lifting device.

3. A shipping and storage container for rolls of sheet material as defined in claim 1 wherein each of said telescopically assembled sections of said box structure is formed of a corrugated paper board panel which is cut, scored and folded to provide an open-topped unit having said bottom and opposite side walls and said single end wall, the latter including a transversely extending upstanding end panel of substantially less depth than that of said side walls and a pair of coplanar spaced-apart corner flaps substantially of the same depth as that of said side walls respectively extending normal to said side walls in overlying relation to said end panel, said end panel and said overlying corner flaps defining therebetween an open-topped slot or opening in the end wall of said section adapted for registry with the hollow interior of said roll core.

4. A shipping and storage container for rolls of sheet material as defined in claim 3 wherein said end wall and overlying corner flaps of each said section are secured together.

5. A shipping and storage container for rolls of sheet material as defined in claim 1 wherein said overlapped portions of said telescopically fitted sections of said box structure are secured in their longitudinally adjusted relation against separation thereof.

6. A shipping and storage container for rolls of sheet material as defined in claim 1 wherein said overlapped portions of said telescopically fitted sections of said box structure are fixedly secured against separation thereof upon a supporting pallet for said structure.

7. A shipping and storage container for rolls of sheet material as defined in claim 1 comprising in combination with said box structure a sectionalized top closure structure formed of a pair of sections each having a top and oppositely disposed vertically depending side walls and a single depending end wall extending transversely between corresponding ends of said side walls, all of the depending walls of each said top section being of a substantially uniform depth adapted to fully enclose said box structure when said top sections are telescopically interfitted to an overall length required as a closure for said box.

8. A combination shipping and storage container as defined in claim 7 wherein all of the separable components thereof are respectively formed of corrugated paper board.

* * * * *